US009557713B2

(12) United States Patent
Peters et al.

(10) Patent No.: US 9,557,713 B2
(45) Date of Patent: Jan. 31, 2017

(54) MODULAR MECHANICAL TIMEPIECE MOVEMENT WITH FUNCTIONAL MODULES

(71) Applicant: ETA SA Manufacture Horlogere Suisse, Grenchen (CH)

(72) Inventors: Jean-Bernard Peters, Pieterlen (CH); Laurent Kaelin, Sonvilier (CH); Ivan Villar, Bienne (CH); Raphael Balmer, Courrendlin (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/333,138

(22) Filed: Jul. 16, 2014

(65) Prior Publication Data

US 2014/0328145 A1 Nov. 6, 2014

Related U.S. Application Data

(63) Continuation of application No. 13/710,737, filed on Dec. 11, 2012.

(30) Foreign Application Priority Data

Dec. 13, 2011 (EP) ..... 11193174

(51) Int. Cl.
*G04B 1/10* (2006.01)
*G04B 18/00* (2006.01)
(Continued)

(52) U.S. Cl.
CPC ..... *G04B 13/00* (2013.01); *G04B 1/00* (2013.01); *G04B 5/00* (2013.01); *G04B 15/14* (2013.01);
(Continued)

(58) Field of Classification Search
CPC ..... G04B 29/00; G04B 29/02; G04B 29/022; G04B 29/027
(Continued)

(56) References Cited

U.S. PATENT DOCUMENTS 3,802,183 A * 4/1974 Erard ..... 368/125
3,881,312 A * 5/1975 Bachmann ..... 368/318
(Continued)

FOREIGN PATENT DOCUMENTS

CH 647 125 G A3 1/1985
CH EP 1079284 A1 * 2/2001 ..... G04B 29/027
(Continued)

OTHER PUBLICATIONS

Adams, Ariel, "Inside Dubois-Depraz—Empire of the Watch Movement Module", Oct. 12, 2011, A Blog to Watch, Retrieved from <http://www.ablogtowatch.com/inside-dubois-depraz-empire-of-the-watch-movement-module/>.*
(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A timepiece sub-assembly includes, irreversibly fixed to a main plate and each irreversibly pre-adjusted by the irreversible securing of adjustment and/or assembly components, after the particular timepiece function thereof has been adjusted and function checked on the test bench, functional modules including a gear train module, a display module, and a time-setting module. Other mechanical sub-assemblies, each irreversibly fixed to the preceding lower order mechanical sub-assembly, include various modules including motor module, frame-mounted self-winding device module, escapement holder regulating module,
(Continued)

motion work train, date module, and self-winding module. A mechanical movement including at least one mechanical sub-assembly of this type and a watch including a mechanical movement of this type are also disclosed. A method of assembling mechanical sub-assemblies of this type by the irreversible securing of mechanical sub-assemblies and irreversibly pre-adjusted modules is also disclosed.

29 Claims, 7 Drawing Sheets

(51) Int. Cl.

| | |
|---|---|
| ***G04B 27/00*** | (2006.01) |
| ***G04B 27/02*** | (2006.01) |
| ***G04B 5/00*** | (2006.01) |
| ***G04B 5/02*** | (2006.01) |
| ***G04B 13/00*** | (2006.01) |
| ***G04B 29/00*** | (2006.01) |
| ***G04B 29/02*** | (2006.01) |
| ***G04B 19/00*** | (2006.01) |
| ***G04B 1/00*** | (2006.01) |
| ***G04B 29/04*** | (2006.01) |
| ***G04B 33/00*** | (2006.01) |
| ***G04B 15/14*** | (2006.01) |
| ***G04B 19/24*** | (2006.01) |

(52) U.S. Cl.
CPC ..... *G04B 19/00* (2013.01); *G04B 19/24* (2013.01); *G04B 27/00* (2013.01); *G04B 29/00* (2013.01); *G04B 29/02* (2013.01); *G04B 29/022* (2013.01); *G04B 29/04* (2013.01); *G04B 33/00* (2013.01)

(58) Field of Classification Search
USPC ..... 368/140, 207, 208, 318
See application file for complete search history.

(56) References Cited

U.S. PATENT DOCUMENTS

| | | | | |
|---|---|---|---|---|
| 3,901,018 | A * | 8/1975 | Erard | 368/300 |
| 4,023,348 | A * | 5/1977 | Giger et al. | 368/88 |
| 4,143,507 | A * | 3/1979 | Ganter | G04C 3/008 368/159 |
| 2005/0007888 | A1* | 1/2005 | Jolidon | 368/110 |
| 2008/0112273 | A1* | 5/2008 | Pellaton | 368/223 |
| 2010/0080088 | A1 | 4/2010 | Koch | |
| 2010/0135126 | A1* | 6/2010 | Born et al. | 368/74 |
| 2010/0278018 | A1* | 11/2010 | Jouvenot | 368/208 |
| 2010/0290321 | A1* | 11/2010 | Martinez et al. | 368/220 |
| 2011/0038233 | A1* | 2/2011 | Martinez et al. | 368/127 |
| 2011/0110199 | A1* | 5/2011 | Girardin et al. | 368/190 |
| 2011/0216631 | A1* | 9/2011 | Pittet | G04B 27/04 368/190 |
| 2012/0092967 | A1* | 4/2012 | Courvoisier et al. | 368/28 |
| 2013/0051190 | A1* | 2/2013 | Villar et al. | 368/132 |

FOREIGN PATENT DOCUMENTS

| | | | |
|---|---|---|---|
| EP | 0 862 098 | A2 | 9/1998 |
| EP | 1 079 284 | A1 | 2/2001 |
| EP | 1 211 578 | A1 | 6/2002 |
| EP | 2 169 479 | A1 | 3/2010 |
| WO | WO 2009/056498 | A1 | 5/2009 |

OTHER PUBLICATIONS

Rebeaud, Jean-Phillippe, English Translation of EP 1079284, originally published Feb. 28, 2001, full document.*

European Search Report issued Aug. 14, 2012 in corresponding European Application No. 11 19 3174 filed on Dec. 13, 2011 (with an English Translation).

* cited by examiner 10
14
15
16
20
30
31
32
33
34
35
36
38
105
108
130
155
D 10
11
14
15
16
18
20
30
37
39
180
181
182
220
391
392
D
1
100
1000

MODULAR MECHANICAL TIMEPIECE MOVEMENT WITH FUNCTIONAL MODULES

CROSS-REFERENCE TO RELATED APPLICATIONS

This application is a continuation of U.S. application Ser. No. 13/710,737 filed Dec. 11, 2012, which claims the benefit of priority from European Patent Application No. 11193174.7, filed Dec. 13, 2011; the entire contents of each of which are incorporated herein by reference.

FIELD OF THE INVENTION

The invention concerns a first mechanical timepiece sub-assembly.

The invention concerns a second mechanical timepiece sub-assembly.

The invention concerns a third mechanical timepiece sub-assembly.

The invention also concerns a fourth mechanical timepiece sub-assembly.

The invention also concerns a fifth mechanical timepiece sub-assembly.

The invention also concerns a sixth mechanical timepiece sub-assembly.

The invention also concerns a seventh mechanical timepiece sub-assembly.

The invention also concerns an eighth mechanical timepiece sub-assembly.

The invention also concerns a mechanical timepiece movement including at least one mechanical timepiece sub-assembly of this type.

The invention also concerns a timepiece or watch including at least one mechanical movement of this type.

The invention also concerns a method of assembling mechanical sub-assemblies of this type.

The invention concerns the field of mechanical horology and more specifically the field of watches.

BACKGROUND OF THE INVENTION

Modular timepieces are known. Although very widely known in electronic horology, they are less frequent in mechanical horology, where modular construction, generally devised to break down the same basic mechanical movement into several calibres with different functions or having a different appearance, is usually more expensive than the traditional method of manufacture. Only a few additional mechanisms, made on additional plates, are relatively widespread.

Modular construction conventionally imposes the constraint of machining high precision interfaces, because of the accumulation of assembly clearances between modules, which require very tight tolerances for each module, to ensure a satisfactory result for the entire unit.

Modular manufacture is also very often detrimental to the total thickness of the mechanical movement, and it is difficult to make ultra flat or even simply flat mechanical movements.

However, modular construction remains an interesting objective for timepiece manufacturers, since it allows assembling tasks to be split. In return for the tighter manufacturing tolerances required by the accumulation of clearances between modules, the final assembly operation can be carried out by less skilled personnel because it is less complicated. However, the final assembly operation still requires the knowledge and sensitivity of a watchmaker.

EP Patent Application No. 1 079 284 in the name of ETA discloses a watch with two main modules each of which contains half of the components.

EP Patent Application No. 0 862 098 in the name of VOSS discloses a modular watch with a timing mechanism forming an entire module.

EP Patent Application No 1 211 578 in the name of ETA discloses an ultra thin electromechanical movement with stacked modules, implementing tubular elements compensating for the variations in thickness of the assembly elements.

SUMMARY OF THE INVENTION

The invention proposes to overcome certain prior art problems by proposing a modular unit which can be assembled without using an operator, while ensuring the exactitude of the working parameters with tried and tested adjustments, and with a lower production cost than that of a traditional method of manufacture.

To this end, the invention concerns a first mechanical timepiece sub-assembly, characterized in that it includes at least one main plate on which is irreversibly fixed a gear train module which is irreversibly pre-adjusted by the irreversible securing of adjustment and/or assembly components, said gear train module including an input wheel set formed by an input pinion, arranged to cooperate with a drum of a motor module, and including a first output wheel set formed by a plate arranged to cooperate with an escapement pinion of an escapement mechanism or of a regulating module, said gear train module further including a second output wheel set formed by a display train cooperating with a display module which is irreversibly pre-adjusted by the irreversible securing of adjustment and/or assembly components, said display module is irreversibly fixed to said main plate and includes an output wheel set formed by at least one indicator arranged to cooperate with a complementary indicator or with a dial, said main plate including a bearing surface for receiving a time-setting module which is irreversibly pre-adjusted by the irreversible securing of adjustment and/or assembly components and including at least one pivot for cooperating with said time-setting module, which is irreversibly fixed to said main plate.

The invention also concerns a second mechanical timepiece sub-assembly, characterized in that it includes, irreversibly fixed to said first mechanical sub-assembly, at least one motor module which is irreversibly pre-adjusted by the irreversible securing of adjustment and/or assembly components, and which is a complete barrel including at least one barrel whose input wheel set is formed by a barrel arbor cooperating with a ratchet comprised in said second mechanical sub-assembly and which is arranged to be pivotally driven, either by said winding and time-setting mechanism or by a self-winding module, to wind at least one spring, in at least one drum forming the output wheel set of said motor module and which drives said input pinion of said gear train module.

The invention also concerns a third mechanical timepiece sub-assembly, characterized in that it includes, irreversibly fixed to said second mechanical sub-assembly, at least one frame-mounted self-winding device module including a barrel drive wheel guided, on the one hand, in a guide member of said first mechanical sub-assembly in proximity to said drum, and on the other hand, in a jewel comprised in a flange centred on two studs comprised in said frame-mounted self-winding device module.

The invention further concerns a fourth mechanical timepiece assembly, characterized in that it includes, irreversibly fixed to said third mechanical sub-assembly, a motion work train including a centre seconds arbor, a small seconds arbor and a pinion mounted on the side of said main plate opposite to the side where said gear train module is assembled, an intermediate wheel carried by a stud driven into said main plate, a cannon-pinion, and a minute wheel carried by a stud driven into said main plate, and an hour wheel.

The invention also concerns a fifth mechanical timepiece sub-assembly, characterized in that it includes, fixed to said fifth mechanical sub-assembly on said motion work train side, a holding plate or a dial, and hands.

The invention also concerns a sixth mechanical timepiece assembly, characterized in that it includes, irreversibly fixed to said fourth mechanical sub-assembly, or to the fifth mechanical sub-assembly, at least one date module including a date drive wheel, an intermediate date wheel pivoting on a stud driven into said main plate, a date corrector wheel meshing with a date control train comprised in said mechanical module comprising a stem, a date indicator bearing on a surface of said main plate, and a holding plate for the date indicator, which is centred by pins driven into said main plate.

The invention further includes a seventh mechanical timepiece sub-assembly, characterized in that it includes, irreversibly secured to said third mechanical sub-assembly, or to said fourth mechanical sub-assembly, or to the fifth mechanical sub-assembly, or to said sixth mechanical sub-assembly, at least a self-winding module including an oscillating weight whose guide member cooperates with a complementary guide member comprised in said bridge of said frame-mounted self-winding device module, and which is held in place by a fixing screw.

The invention further concerns an eighth mechanical timepiece sub-assembly, characterized in that it forms an autonomous mechanical timepiece movement, and includes, irreversibly secured to said third mechanical sub-assembly, or to said fourth mechanical sub-assembly, or to the fifth mechanical sub-assembly, or to said sixth mechanical sub-assembly, an escapement holder regulating module, which is a functional module for performing a particular timepiece function, irreversibly pre-adjusted by the irreversible securing of adjustment and/or assembly components comprised in said functional module after said particular timepiece function has been adjusted and function checked on the test bench, and said escapement holder regulating module includes a regulating assembly, whose input wheel set is formed by an escape wheel arranged to be moved by a small seconds wheel comprised in said gear train module, and whose output wheel set is formed by said same escape wheel, said escapement holder regulating assembly including a sprung balance assembly, an escapement, and a particular pallet lever.

The invention further concerns a mechanical timepiece movement including at least one mechanical timepiece sub-assembly of this type, characterized in that each functional module, comprised in said mechanical movement for performing a particular timepiece function, is irreversibly pre-adjusted by the irreversible securing of adjustment and/or assembly components comprised in said functional module after said particular timepiece function has been adjusted and function checked on the test bench.

The invention also concerns a timepiece or watch including at least one mechanical movement of this type.

The invention further includes a method of assembling these mechanical sub-assemblies, characterized in that said first mechanical sub-assembly is assembled by irreversibly securing said main plate and said irreversibly pre-adjusted modules comprised therein, and in that each higher order mechanical sub-assembly is assembled on the lower order mechanical sub-assembly by irreversibly securing said lower order mechanical sub-assembly and said irreversibly pre-adjusted modules comprised in said higher order mechanical sub-assembly.

BRIEF DESCRIPTION OF THE DRAWINGS

Other features and advantages of the invention will appear upon reading the following detailed description, with reference to the annexed drawings, in which:

FIG. 1 illustrates a gear train module arranged directly on a plate of the mechanical movement.

FIG. 2 illustrates the assembly of a functional stem mechanism module, in a preferred embodiment wherein said module performs both the time-setting and manual winding functions, as well, in an optional embodiment, as the date setting function.

FIG. 3 illustrates the locking into position of said stem mechanism module.

FIG. 4 illustrates the assembly of a functional motor module, comprising a complete barrel here.

FIGS. 5 to 8 show the assembly of individually assembled components: barrel arbor, small seconds wheel, barrel drive wheel and frame pillar.

FIG. 9 illustrates the assembly of a frame-mounted self-winding device module.

FIGS. 10 to 14 show the assembly of individually mounted components: retaining clips for the frame-mounted self-winding device module, sliding gear return spring, intermediate barrel drive wheel, sliding gear, stop pinion.

FIG. 15 illustrates the assembly of a bar fitted with the self-winding device.

FIG. 16 illustrates the assembly of a pre-adjusted functional adjustment module, comprising here a sprung balance unit, a pallet lever and an escapement.

FIGS. 17 to 21 illustrate the assembly of a display module, on the opposite side of the main plate relative to the side on which all the modules and components of FIGS. 1 to 16 are assembled, and after the pre-assembled mechanical sub-assembly seen in FIG. 16 has been turned over, with the appropriate components in place: intermediate wheel, cannon-pinion, minute wheel and hour wheel.

FIGS. 22 to 26 illustrate the assembly of an optional date mechanism with the following elements in place: date drive wheel, intermediate date wheel, date corrector wheel, date indicator, date indicator holding plate.

FIGS. 27 and 28 illustrate the assembly of an optional self-winding functional module, with a pre-fitted oscillating weight and the screw securing said weight in place.

DETAILED DESCRIPTION OF PREFERRED EMBODIMENTS

Figure 3:
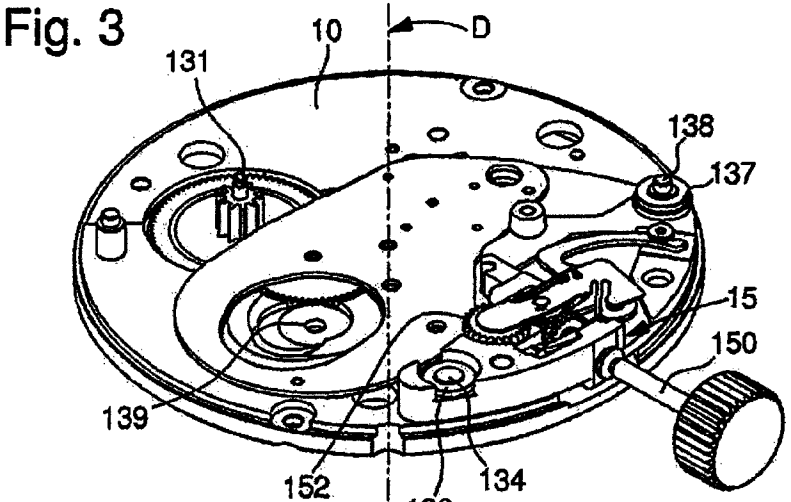
FIGS. 1 to 28 show schematic, perspective views of various successive states of assembly of a mechanical movement according to the invention, wherein FIGS. 1 to 21 concern a complete basic mechanical movement.

The invention concerns the field of mechanical horology and more specifically the field of watches.

The invention concerns a mechanical timepiece movement 100 in the form of a modular unit.

According to the invention, this mechanical movement 100 includes at least one functional module 1 for performing a particular timepiece function which is irreversibly pre-adjusted by the irreversible securing of adjustment and/or assembly components comprised in said functional module 1 after this particular timepiece function has been adjusted and function checked on the test bench.

This at least one pre-adjusted functional module 1 is irreversibly secured, either to a main plate 10 of mechanical movement 100 or of another pre-adjusted functional module 1 of mechanical movement 100, or it is irreversibly secured to another pre-adjusted functional module 1 of mechanical movement 100.

In a preferred embodiment of the invention, seen in the Figures, this mechanical timepiece movement 100 includes a plurality of these functional modules 1, each pre-adjusted to perform a particular timepiece function. These functional modules 1 are each mounted, or irreversibly secured, directly or indirectly relative to main plate 10, or sandwiched between functional modules 1 and/or components of mechanical movement 100, which are in turn irreversibly fixed, directly or indirectly with respect to main plate 10. Naturally, a functional module 1 can be sandwiched between main plate 10 and at least one other component or at least one other functional module 1.

Each functional module 1 is a mechanical module formed from a mechanical sub-assembly comprising all the components required to perform a particular timepiece function of transforming a mechanical movement between at least one input wheel set and at least one output wheel set.

This mechanical sub-assembly includes adjustment and/or assembly components which are irreversibly fixed after the particular timepiece function peculiar to the functional module concerned has been adjusted and function checked. The individual sub-assembly is adjusted and function checked on the test bench. The actual functional module 1 is thus a pre-adjusted module obtained from the transformation of a mechanical sub-assembly of this type, by irreversibly securing its adjustment and/or assembly components.

Preferably, each functional module 1 includes at least a first bearing surface, and a locating means for recognising and positioning module 1 relative to another element of mechanical movement 100, or relative to main plate 10. This positioning is achieved by the first bearing surface bearing on a complementary bearing surface comprised in said other element or plate 10. The notion of a "bearing surface" is understood in the broadest sense. A "bearing surface" may equally well be formed by a bore or arbor, or a flat surface or other element.

The locating means may be devised to locate with or without contact, and may take several forms, which may be combined with each other:

- in an advantageous variant for automated manufacture, the locating means includes an optical locating means for the optical recognition and positioning of module 1,
- in another variant, the locating means includes an acoustic or ultrasound locating means for the recognition and positioning of module 1;
- in another variant, the locating means includes a mechanical locating means for the mechanical recognition and positioning of module 1, such as lugs, bores, sensors, stop members or suchlike.

The invention is more specifically devised for the automated manufacture of mechanical movement 100 and endeavours to allow various modules and components to be set in place in a parallel direction to a single direction of insertion D, selected here to be parallel to the gear train axes, with the fewest possible turning-over movements or other movements apart from movements of translation.

In a preferred embodiment, the first bearing surface of each functional module 1 is flat and presented perpendicularly to this direction of insertion D.

Preferably, functional module 1 includes at least a second bearing surface parallel to the first bearing surface. This arrangement facilitates automated assembly by paraxial positioning relative to direction of insertion D, with certain components or modules stacked with their bearing surfaces perpendicular to the direction of insertion D in contact with each other?.

To ensure some of the cooperation between assembly components, particularly the gearing between toothed wheels, or between wheels and racks, ratchets or suchlike, or to set in place cams, jumper springs, clicks, fingers, pushers or suchlike, functional module 1 may also advantageously include at least one pivot guide member, for pre-assembling the module while allowing it a degree of freedom to pivot. It is therefore possible to ensure this cooperation in a final pivoting movement of module 1. In a preferred but non-limiting embodiment, this pivotal guiding is performed relative to a parallel direction to said direction of insertion D. This is the case of regulating module 16 in the mechanical movement set out in detail below.

In a variant, module 1 includes a guide means arranged to cooperate with a complementary guide means comprised in another module 1, or a component of mechanical movement 100 or plate 10, to achieve a similar cooperation by translation, or a parallel adjustment, in one plane, in the manner of a slide or a drawer. Preferably, these guide means are made in a perpendicular direction to direction of insertion D.

The Figures illustrate a mechanical movement 100, whose composition comprises functional modules 1 of this type and isolated components which combine to form functional mechanical sub-assemblies. The reduction in the number of objects to be handled during assembly of the movement, and especially the reduction or absence of any adjustment operations, are made possible by the concept of pre-adjusted functional units. It will be noted that, although some components are mounted individually here, this is essentially for the purpose of reducing or limiting the thickness of the mechanical movement, since it is also possible to secure these components, which participate in the same kinematic chain of one functional sub-assembly, to an additional plate, but this would then have a detrimental effect on the total thickness of the mechanical movement.

The mechanical movement described below requires only 21 objects to be handled in the basic version (a mechanical movement with no mechanically wound date mechanism), namely 5 pre-adjusted modules and 16 individual or pre-assembled components (for example arbors and wheels). All the mechanical assembly motions are translational motions parallel to each other, and only one pivoting motion is required for the gearing of a regulating module. Assembling the date mechanism requires 5 additional components to be set in place, whereas assembling the self-winding mechanism requires only 2 components to be set in place, i.e. a module and a screw.

The gearing cooperation can be achieved either with complementary guide tools, or by pivoting the head of the manipulator system.

In a preferred implementation, the assembly is carried out a by a robot controlled by a control means which cooperates with a shape recognition means, particularly a mechanical and/or optical means, which identifies the shape and position of locating means belonging to modules 1 and/or the retail components.

There are six functional modules used here.

A first type of functional module 10 is a motor module 11 and it is a complete barrel which comprises at least one barrel 110, whose input wheel set is formed by a barrel arbor 111, which cooperates with a ratchet 12, which may or may not be incorporated in said motor module 11, and which is arranged to be pivoted, either by a manual winding mechanism or by a winding and time-setting mechanism 15, or by a self-winding mechanism or by a self-winding module 18, to wind at least one spring (not shown in the Figures) in at least one drum 113 forming the output wheel set of said motor module 11. This drum 113 is arranged for driving an input pinion 131 of a gear train or a gear train module 13.

Another type of functional module 1 is a gear train module 13, the input wheel set of which is formed by an input pinion 131, arranged to cooperate with a drum 113, and a first output wheel set of which is formed by a fourth wheel arranged to cooperate with an escape pinion connected to an escape wheel comprised in an escape mechanism or a regulating module 16.

Advantageously, this gear train module 13 includes a second output wheel set which is formed by a display train arranged to cooperate, either with display means comprised in the gear train module 13, or with a display module 14 external to gear train module 13, or carried by the same plate, and comprising display means.

This display module 14 has an input wheel set formed by a display train comprised in a gear train mechanism or gear train module 13 and an output wheel set formed by at least one indicator arranged to cooperate with a complementary indicator or with a dial comprised either in display module 14 or mechanical movement 100 or a timepiece 1000 incorporating said movement.

Advantageously, this gear train module 13 or display module 14 includes a motion work mechanism, which is friction connected to the gear train disclosed in EP Patent Application No. 11177840 by the same Applicant, and includes a fourth wheel set pre-assembled on a centre tube, which is the subject of EP Patent Application No. 11177839 by the same Applicant.

Yet another type of functional module 1 is a time-setting module 15, the input wheel set of which is formed by a stem 150 arranged to be moved by a user, and a first input wheel set of which is formed by a motion work control train 151.

Preferably, this time-setting module 15 is also a time-setting and winding module, and includes a second output wheel set which is formed by a winding control train 152.

Advantageously, this module 15 is made with a winding stem mechanism according to EP Patent Application No. 11170180 by the same Applicant. It may also integrate a device for manual winding via pressure on the stem according to EP Patent Application No. 11177838 by the same Applicant.

Yet another type of functional module 1 is a regulating module 16 comprising a regulating unit, and the input wheel set thereof is formed by an escape wheel arranged to be moved by a fourth wheel comprised in a gear train or gear train module 13, and the output wheel set of which is formed by said same escape wheel.

This platform escapement regulating module 16 is advantageously made in accordance with the characteristics of EP Patent Application Nos. 11005713 and 11179181 by the same Applicant, and includes a sprung balance assembly, an escapement and a particular pallet lever.

A particular functional module 1 is a self-winding module 18, the input wheel set of which is formed by an oscillating weight 180 moved by the motions of a user or an external tool, and the output wheel set of which is formed by a drive train of a ratchet 12 comprised either in a motor mechanism, or a motor module 11, or a ratchet 12 which cooperates with a barrel comprised either in a motor mechanism or a motor module 11.

This oscillating weight 180 is advantageously made in accordance with the characteristics of EP Patent Application No. 11188261 by the same Applicant.

FIGS. 1 to 28 illustrate the composition and assembly of a mechanical timepiece movement 100 forming a modular unit according to the invention, in a preferred and non-limiting sequence of operations to position and secure the various modules and components forming the mechanical movement.

According to the invention, all the modules and components which form mechanical movement 100 can be inserted in a parallel direction to a direction of insertion D, which is parallel to the axes of the gear train here.

In a preferred and non-limiting embodiment of the invention, each mechanical sub-assembly formed of an assembly of plates, bars and pre-adjusted functional modules 1 according to the invention, is irreversibly fixed as soon as each additional one-piece module is set in place.

Figure 1:
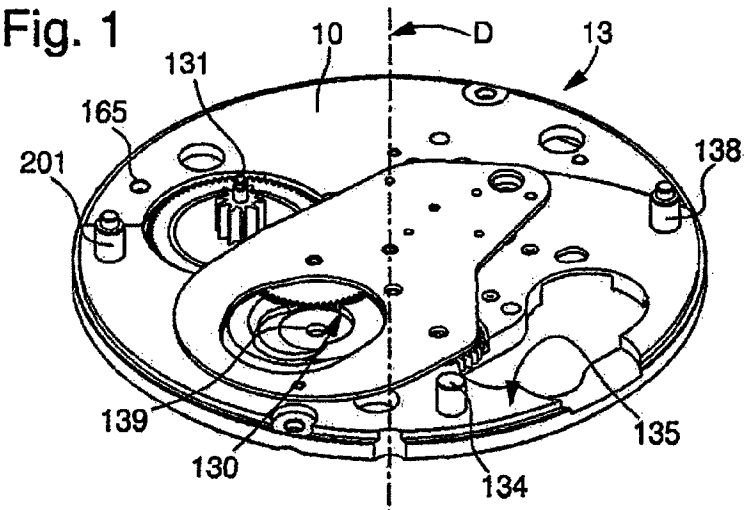

FIG. 1 illustrates an assembled equipped main plate, which forms a base on which various modules and components are assembled. A gear train module 13 is arranged here directly on a main plate 10 of movement 100, to avoid increasing the thickness thereof. In an alternative embodiment, not illustrated in the Figures, gear train module 13 includes another plate, which can be affixed to the main plate 10 during assembly.

In this embodiment, this same plate 10 carries a display module 14 as described above.

Plate 10 has a bearing surface 135 for receiving a time-setting module 15 and a pivot 134 for cooperating with said module.

Two shouldered studs 201 and 138 are mounted to cooperate with a frame mounted self-winding device 20?

The gear train is not detailed here. FIG. 1 shows an input pinion 131 which is a third wheel pinion.

Counter-bores 130 are arranged around a centring bore 139, intended to receive a barrel arbor, to prevent a collision with a complete barrel, forming a motor module 11, during assembly.

Plate 10 further includes a bore 165 for receiving an arbor 162 of a regulating module 16.

Figure 2:
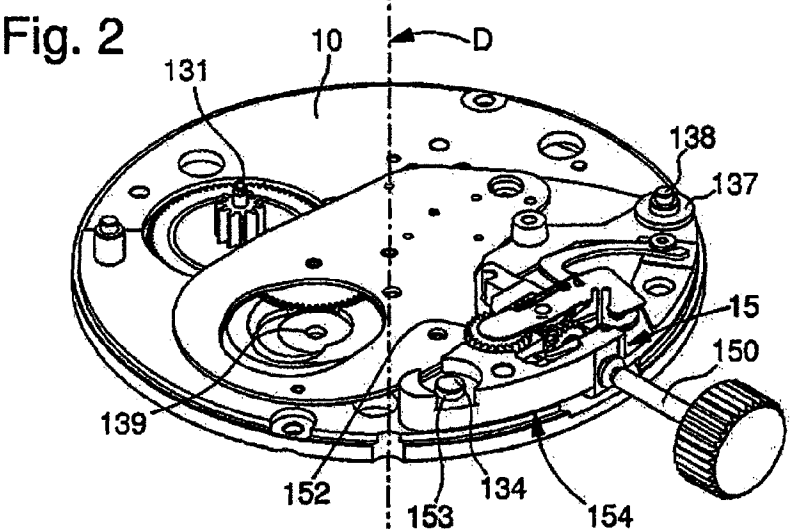

FIG. 2 shows the assembly of a stem mechanism module 15, more specifically a time-setting module, on said plate 10, via a bore 153 of module 15 engaged on pivot 134, and a bearing surface 154 of module 15 abutting on bearing surface 135 of plate 10. This module 15 includes a stem 150 connected to a crown to allow the user to adjust the time of the mechanical movement. The first output wheel set is formed by a motion work control train 151. In a preferred embodiment illustrated in the Figures here, this module 15 also performs the function of a manual winding module and the second output wheel set is formed by a winding control train 152. The user pulls on stem 150 in a conventional manner to select the chosen function.

FIG. 3 shows stem mechanism module 15, after assembly, locked by two rings 136 and 137 respectively driven onto staged studs 134 and 138 of plate 10. Driving on the rings enables the mechanical sub-assembly to be handled safely.

Figure 4:
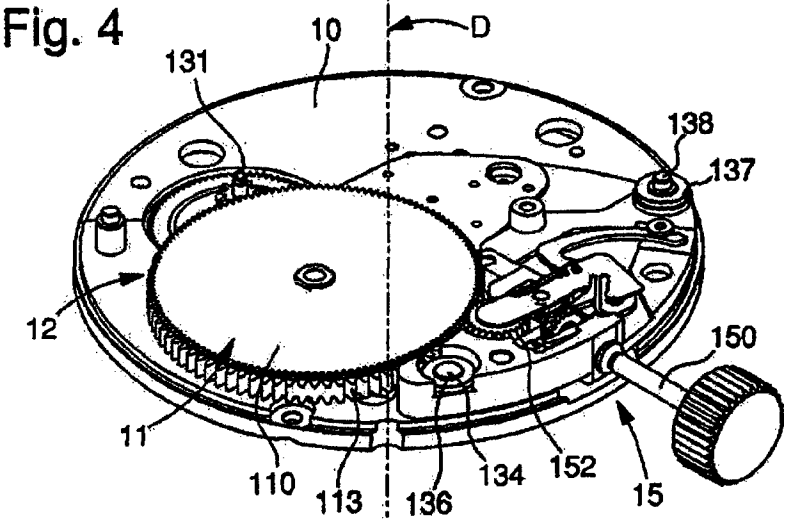

FIG. 4 shows the assembly of a motor module 11 of the type described above. Barrel 113 is first of all meshed with pinion 131 of the third wheel using an assembly tool. The barrel is then pivoted on a gyration radius concentric to the position of the centre wheel, so as to bring module 11 with ratchet-cover 12 into mesh with intermediate wheel 152 of the winding train of stem mechanism module 15.

Figure 5:
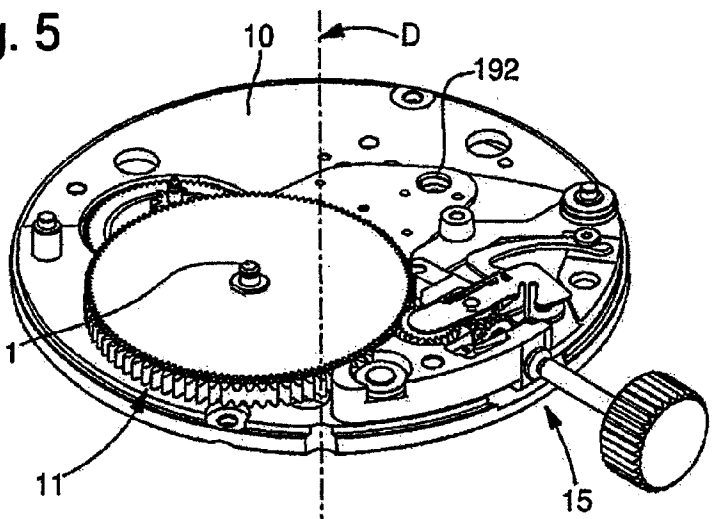
Figure 6:
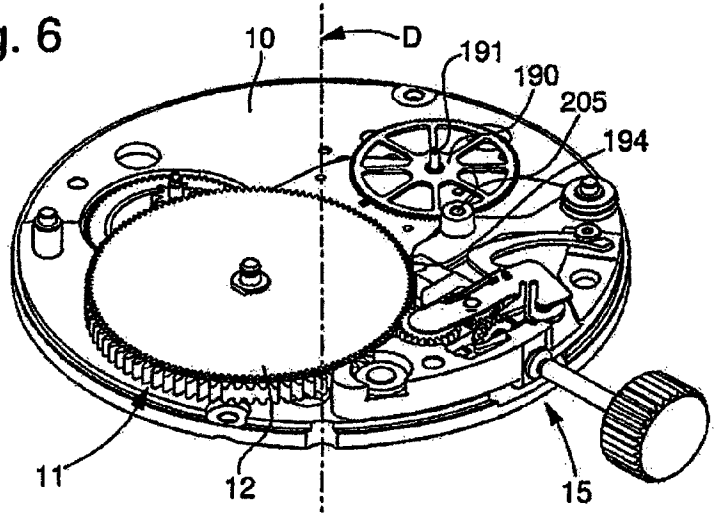

FIG. 5 illustrates the barrel arbor 11 being assembled from below in bore 139 of plate 10. In a preferred embodiment, this barrel arbor has a shouldered head like a nail, which is mounted here underneath plate 10, on the side intended to receive the dial, which is not visible in FIG. 5. This barrel arbor 111 is fitted into a bore in a core of barrel 113 onto which the barrel spring is hooked, and which includes a first shoulder cooperating with a bore in the drum, and a second shoulder, which cooperates with the ratchet-cover 12.

Plate 10 further includes a bore 192 for the assembly (illustrated in FIG. 6) of an arbor 191 of a small seconds wheel 190.

Figure 12:
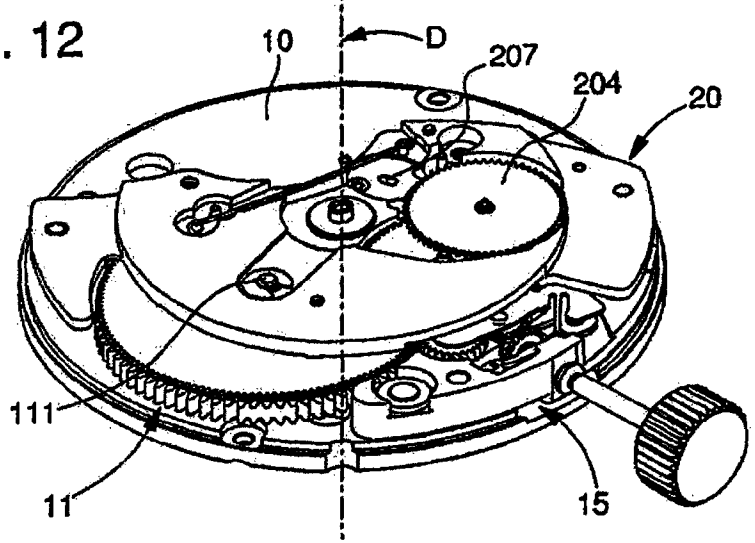

In proximity to said small seconds wheel 190, a guide member 205 is provided for receiving a barrel drive wheel 204, the assembly of which is shown in FIG. 12.

Figure 7:
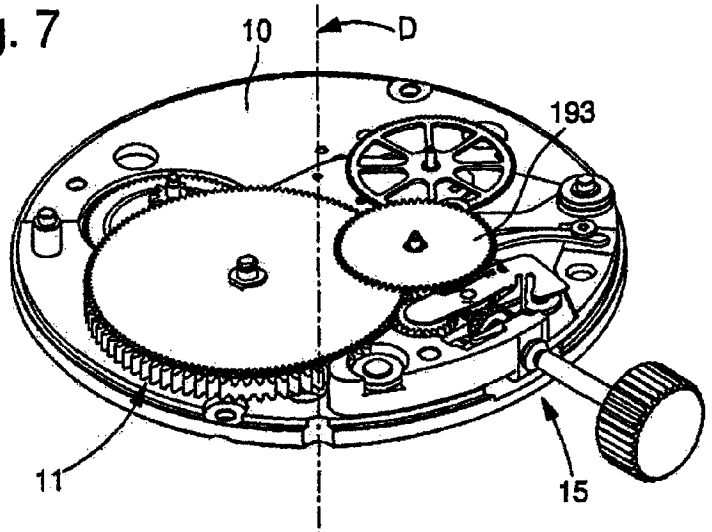
Figure 15:
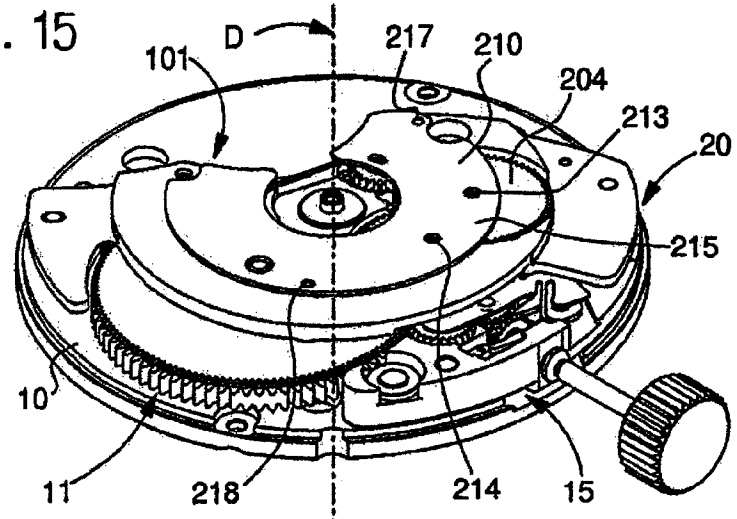
Figure 16:
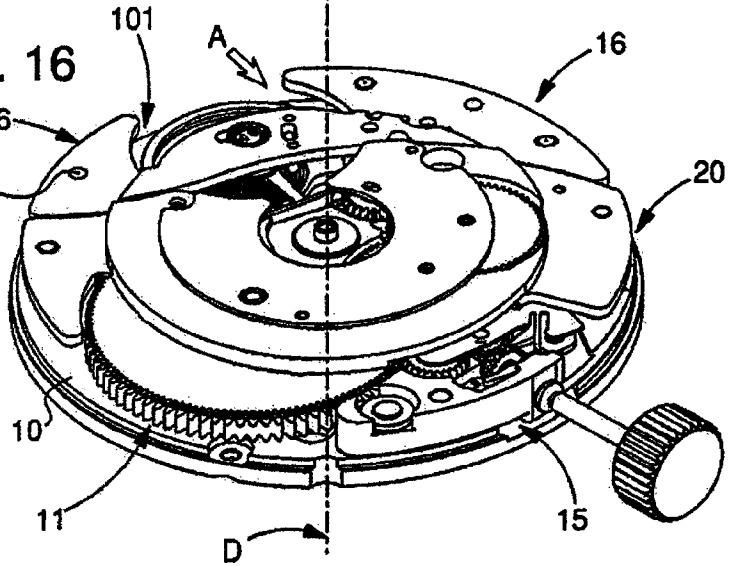

In proximity to drum 113, a guide member 194 is provided for receiving a barrel drive wheel 193, the assembly of which is seen in FIG. 7. During assembly, this guide member 194 holds said wheel 193 in a vertical position until the assembly of a bar 200 of a frame mounted self-winding device 20 and then a flange 215 comprising a jewel 213 for the top guiding thereof, as seen in FIG. 15.

Figure 8:
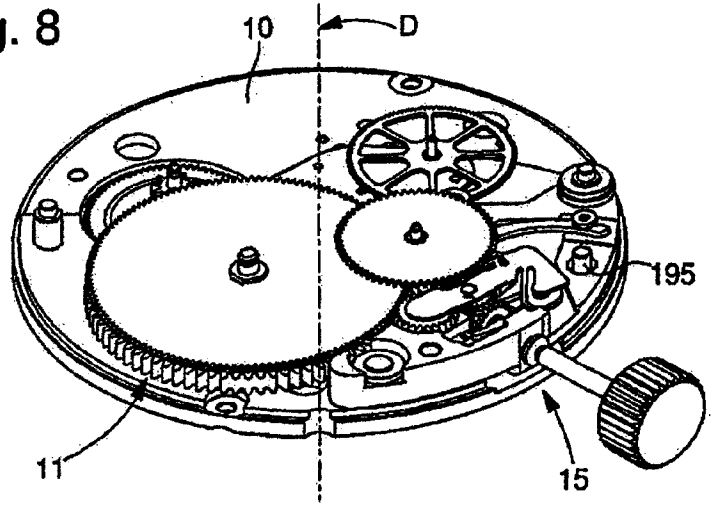

FIG. 8 shows the assembly of a pillar 195 for a frame mounted self-winding device 20, said pillar being secured, not to plate 10, but in a bore of a bar comprised in module 15.

Figure 9:
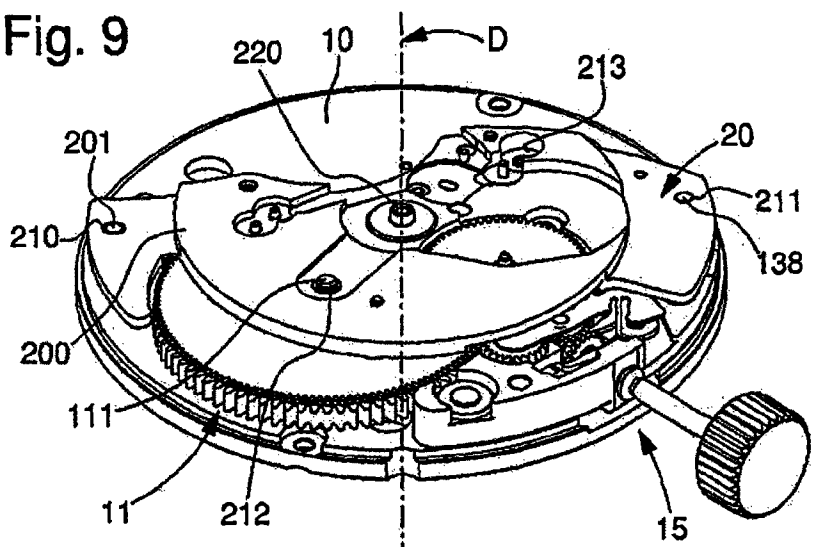

FIG. 9 shows the assembly of frame mounted self-winding device 20, which comprises a bar 200. This bar 200 has two bores 210 and 211 for cooperating with the ends of shouldered studs 201 and 138 driven into plate 10. It also includes a bore 212 for guiding barrel arbor 111 and a jewel 213 for guiding the arbor of small seconds wheel 191. Bar 200 also includes a guide member 220 for an oscillating weight 180.

This bar 200 may be directly welded to plate 10 thereby sandwiching the already assembled components, or welded at the ends of studs 201 and 138 or suchlike.

Figure 10:
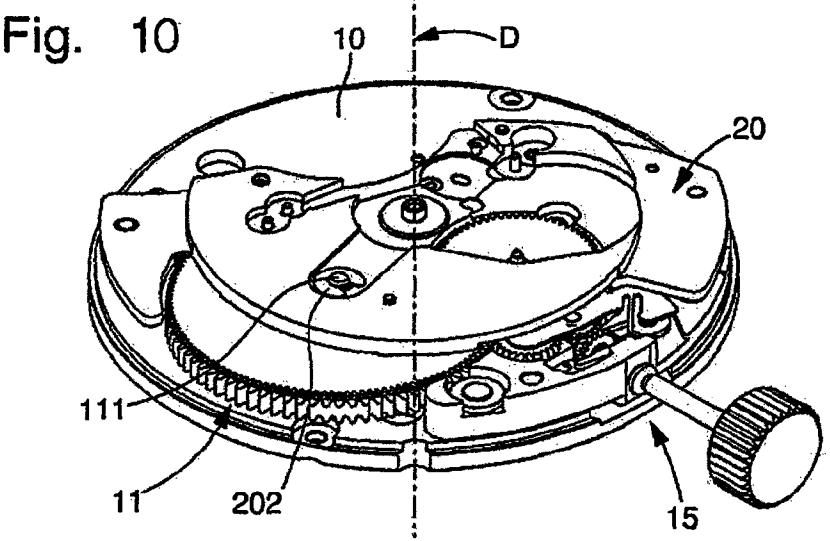

FIG. 10 illustrates the assembly of a retaining means, formed here by a clip 202 or by a key or similar element, for retaining the bar of the self-winding device in the event of a shock applied to mechanical movement 100 and especially for holding barrel drive wheel 193. In fact, the strong inertia of oscillating weight 180, which pivots in guide member 220 of bar 200, may, in the event of a shock, have the effect of applying a traction stress on the median part of frame 20.

Figure 11:
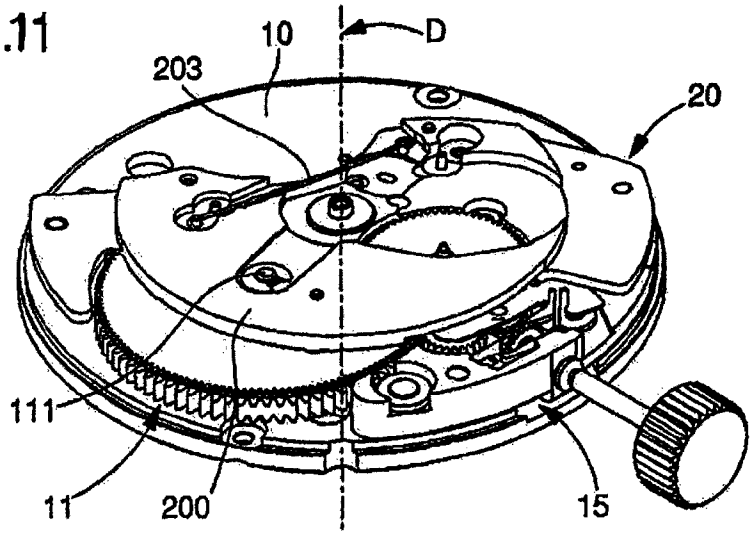

A sliding gear return spring 203 is then mounted in abutment on raised portions of bar 200, as seen in FIG. 11.

Figure 13:
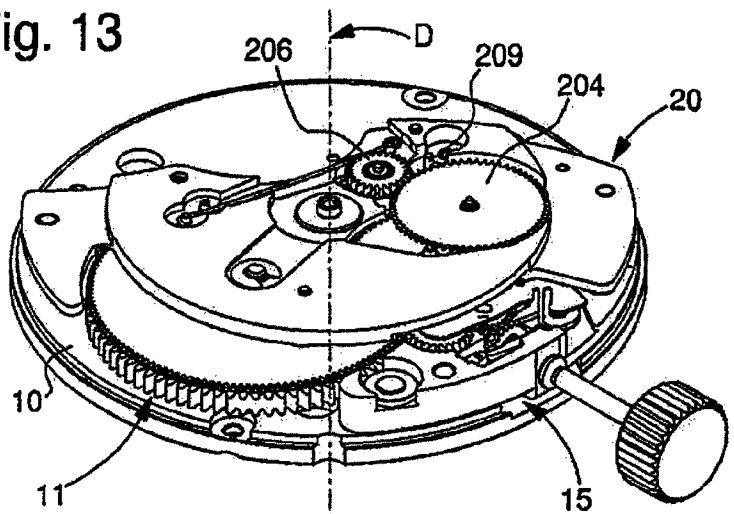
Figure 14:
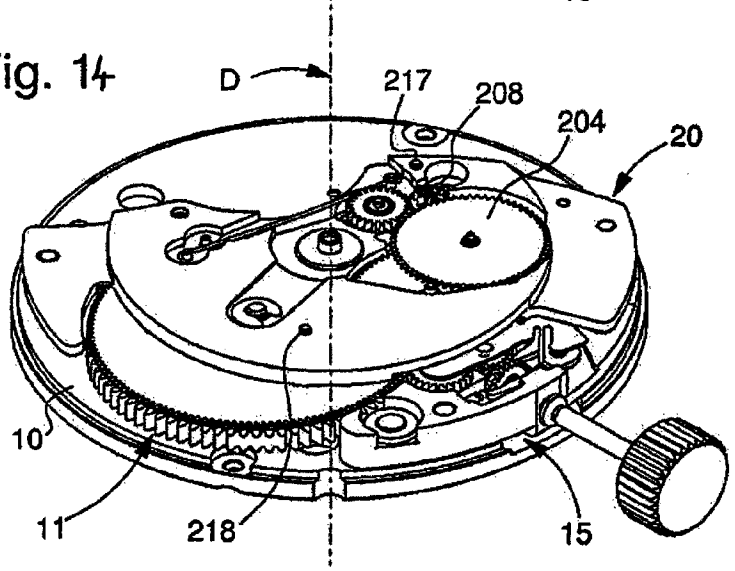

FIG. 12 then shows the assembly of intermediate barrel drive wheel 204 in its guide member 205. The Figure shows an oblong hole 207 arranged in bar 200 for receiving the arbor of a sliding gear 206, the assembly of which is shown in FIG. 13. The neighbouring guide stud 209 is used as a pivot for a stop pinion 208, the assembly of which is shown in FIG. 14.

Two centring studs 218 and 217 position a flange 215, which includes jewels 213 and 214 for guiding the intermediate barrel drive wheel 204 and barrel drive wheel 193, and a top oblong hole 218 for guiding sliding gear 206.

At this stage, the mechanical sub-assembly thereby formed is ready to receive a regulating module 16, preferably carrying the sprung balance and the escapement, as explained above.

This regulating module 16 includes a stud 162 arranged to cooperate with bore 165 of the plate. It is easy to pre-position regulating module 16 by inserting it in the direction of insertion D, in abutment on plate 10 via a bottom bearing surface 101, in an angular orientation wherein the module projects outside plate 10. A pivoting motion in direction A allows said module to cooperate with the rest of the mechanical movement, as explained in EP Patent Application No. 11005713 by the same Applicant, in the position illustrated in FIG. 16.

At this stage, the mechanical manual winding movement can function, and the assembled unit can be handled in any position without the loss or movement of any components.

An optional self-winding module 18 can be mounted at this stage, or later in the assembly sequence. However, since the mechanical sub-assembly has to be turned over for the final assembly of the motion work, it is preferable to postpone the assembly of oscillating weight 180 for as long as possible in the assembly sequence, since otherwise it would have to be held during manipulations.

Figure 17:
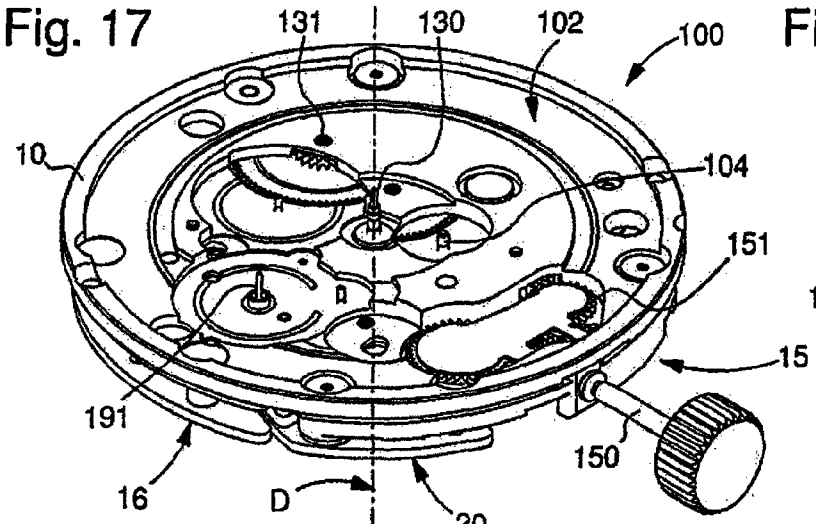

Thus, FIG. 17 shows the pre-assembled movement 100 turned over. Plate 10 has a surface 102 that can act as support, as appropriate, for a dial or a date disc or similar.

The stem mechanism module 15 controls the minute control train 151, which meshes with the motion work.

The centre seconds arbor 1300 is at the centre of mechanical movement 100 here. The small seconds arbor 191 and centre wheel arbor 131 are visible. They are preferably all pre-mounted at the stage of display module 14 which is formed on the back of main plate 10, while gear train module 13 is essentially mounted on the front side of said plate 10. The unit forms a single basic structural module here, but could also be split into two independent modules.

Figure 18:
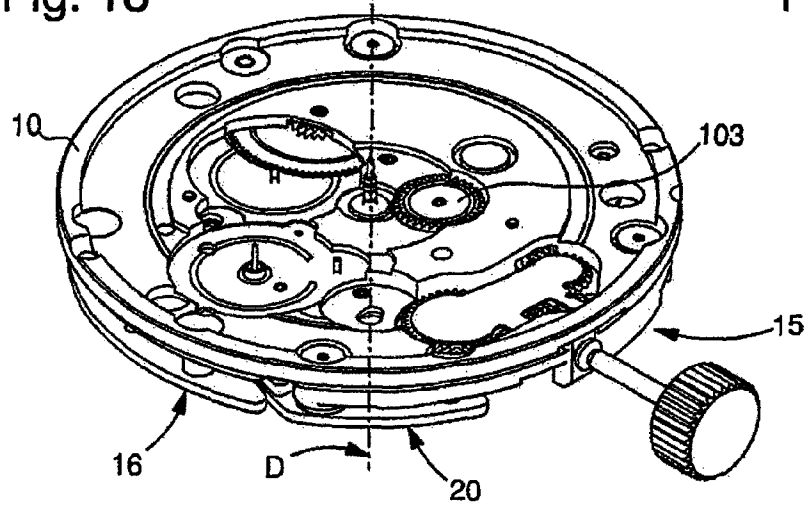

In FIG. 18, a stud 104 driven into plate 10 receives an intermediate wheel 103.

Figure 19:
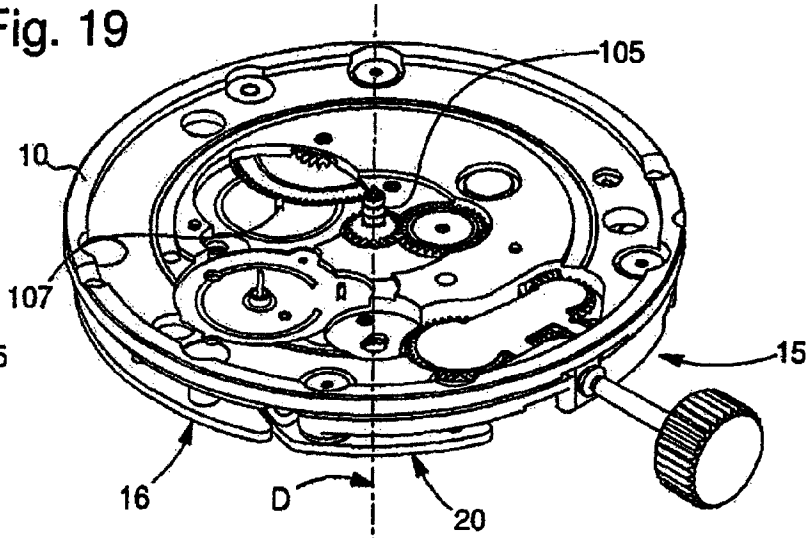
Figure 20:
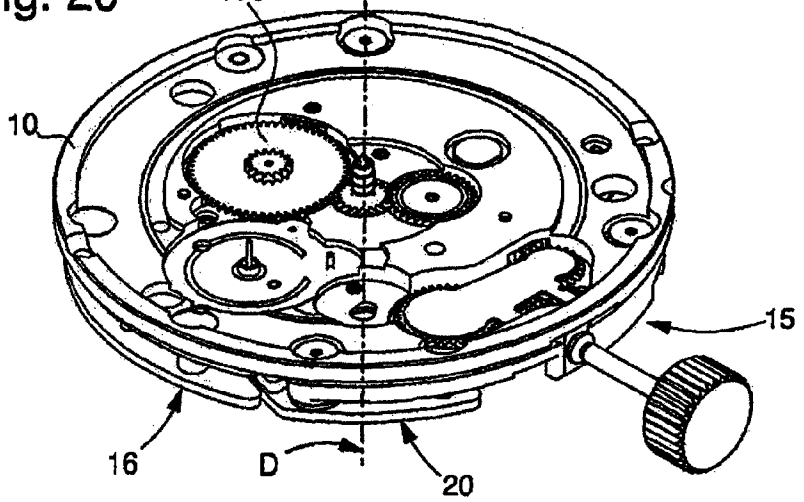

The cannon-pinion 105 is assembled in FIG. 19, then minute wheel 106 is assembled in FIG. 20, on a stud 107 driven into plate 10.

Figures 21, 22, 23, 24:
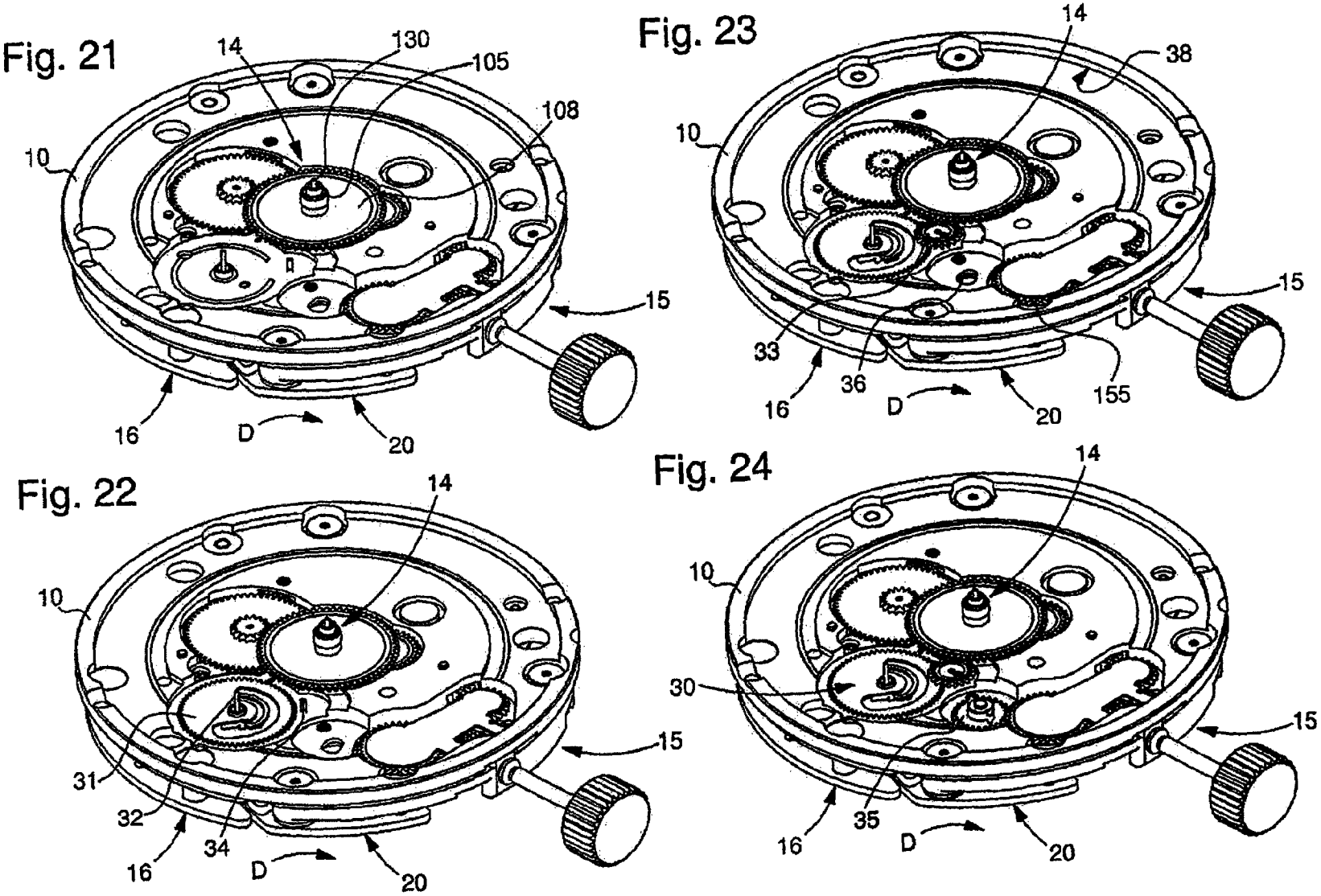

FIG. 21 shows the assembly of hour wheel 108.

At this stage, movement 100 can be closed, on the motion work side, by a holding plate or dial, not shown in the Figures, and the mechanical movement is completely operational as soon as the hands have been mounted.

Figures 25, 26, 27, 28, 29:
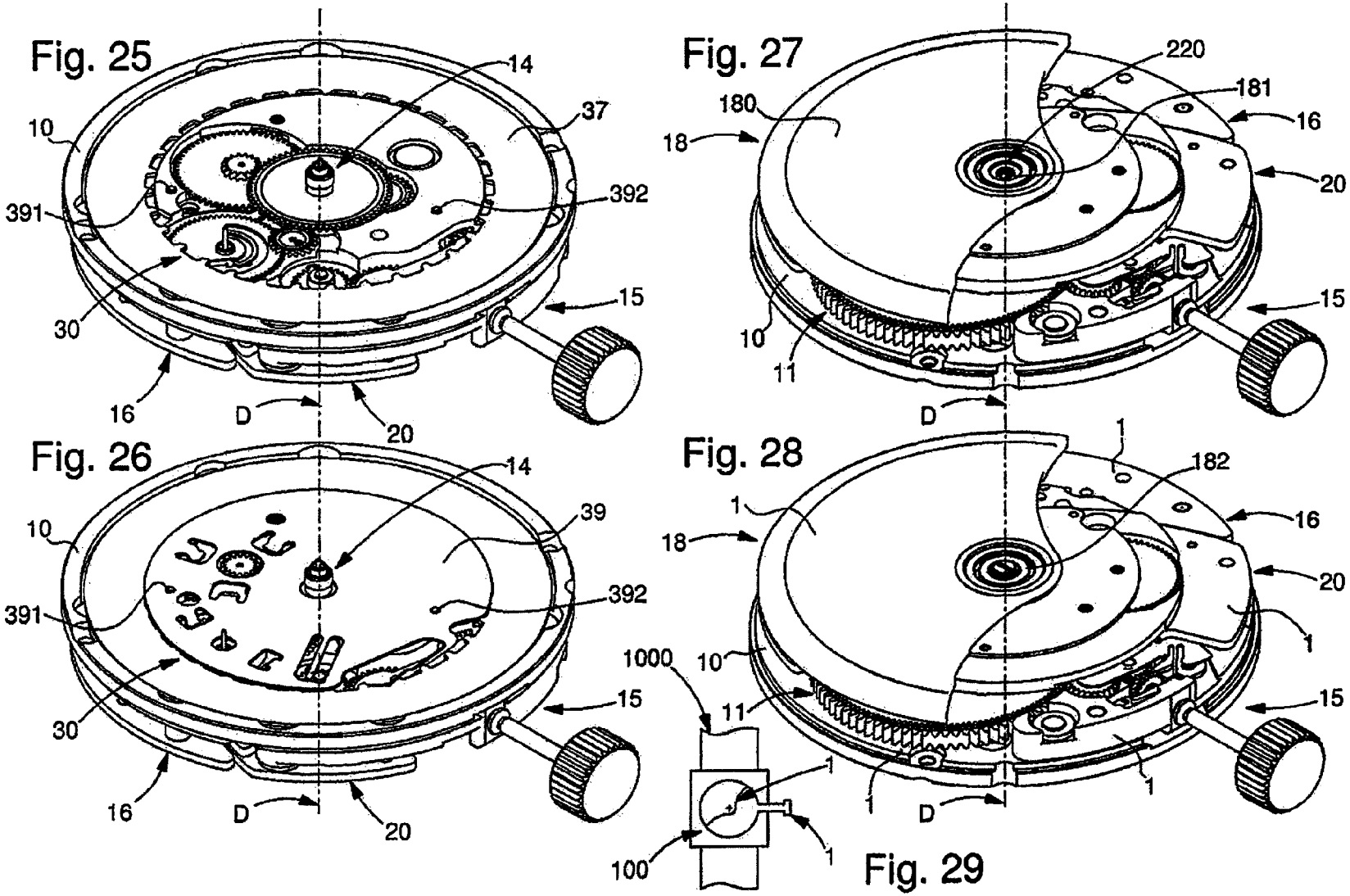
FIG. 29 shows a schematic view of a timepiece including a mechanical movement of this type fitted with several functional modules.

In a non-limiting variant illustrated in FIGS. 22 to 25, movement 100 is also fitted with a date mechanism 30. FIG. 22 shows the assembly of a date drive wheel 31. FIG. 23 shows the assembly of an intermediate date wheel 33, pivoting on a stud 34 driven into plate 10, and FIG. 24 shows the assembly of a date corrector wheel 35, in mesh with a date control train 155 comprised in the stem mechanism module 15. A date indicator 37 is set in place, bearing on surface 102 as seen in FIG. 25, a date indicator holding plate 39 is then assembled in FIG. 26, centred by studs 391 and 392 driven into plate 10.

FIGS. 27 and 28 illustrate the assembly of a self-winding module 18 with an oscillating weight 180.

A guide member 181 for oscillating weight 180 cooperates with a guide member 220 comprised in frame-mounted self-winding device 20. Finally, a fixing screw 182 is set in place in FIG. 28.

Self-winding mechanical movement 100 is then completely assembled and ready to operate.

The invention also concerns a timepiece 1000 including at least one such mechanical movement 100.

The invention has the advantage of combining, within one mechanical movement which forms a modular unit of this type, functional modules, which have each been pre-adjusted and pre-tested, and which do not require any subsequent adjustment during the final assembly of the mechanical movement.

What is claimed is:

1. An assembly comprising:

a first mechanical timepiece sub-assembly, wherein the sub-assembly comprises at least one main plate on which is irremovably fixed a gear train module which is irreversibly adjusted by irremovable securing of adjustment and/or assembly components, said gear train module including an input wheel set formed by an input pinion, arranged to cooperate with a drum of a motor module, and including a first output wheel set formed by a plate arranged to cooperate with an escapement pinion of an escapement mechanism or of a regulating module, said gear train module further including a second output wheel set formed by a display train cooperating with a display module which is irreversibly adjusted by the irremovable securing of adjustment and/or assembly components, said display module is irremovably fixed to said main plate and includes an output wheel set formed by at least one indicator arranged to cooperate with a complementary indicator or with a dial, said main plate including a bearing surface to receive a time-setting module which is a first functional module to perform a particular timepiece function, irreversibly adjusted by the irremovable securing of adjustment and/or assembly components comprised in said first functional module after said particular timepiece function has been adjusted and function checked on a test bench, and said main plate including at least one pivot to cooperate with said time-setting module, which is irremovably fixed to said main plate and includes a bore in which said pivot is accommodated, and a second mechanical timepiece sub-assembly including, irremovably secured to said first mechanical sub-assembly, a second functional module to perform a particular timepiece function, irreversibly adjusted by the irremovable securing of adjustment and/or assembly components comprised in said second functional module after said particular timepiece function has been adjusted and function checked on the test bench.

2. The assembly according to claim 1, wherein said input pinion is a centre wheel pinion.

3. The assembly according to claim 1, wherein said time-setting module includes a bearing surface bearing on said bearing surface of said main plate.

4. The assembly according to claim 1, wherein said time-setting module includes a stem connected to a crown, to allow a user to adjust a time-setting of a mechanical movement, and includes a first output wheel set formed by a motion work control train.

5. The assembly according to claim 4, wherein said time-setting module also performs a function of a manual winding module, and includes a second output wheel set formed by a winding control train cooperating with said ratchet, and wherein pulling on said stem by the user determines a selection of a chosen function.

6. The assembly according to claim 1, wherein said time-setting module is locked onto said main plate by two rings driven onto shouldered studs comprised in said main plate.

7. The assembly according to claim 1, wherein said gear train module and said time-setting module are arranged only on a first side of said main plate.

8. The assembly according to claim 7, wherein all of the components thereof are arranged on said first side of said main plate.

9. The assembly according to claim 1, wherein the second mechanical timepiece sub-assembly includes, irremovably secured to said first mechanical sub-assembly, at least one motor module, which is the second functional module, and is a complete barrel including at least one barrel, whose input wheel set is formed by a barrel arbor, which cooperates with a ratchet comprised in said second mechanical sub-assembly and which is arranged to be pivoted, either by a winding and time-setting mechanism, or by a self-winding mechanism or by a self-winding module, to wind at least one spring in at least one drum forming the output wheel set of said motor module and which drives said input pinion of said gear train module.

10. The assembly according to claim 9, wherein, around a centring bore receiving said barrel arbor, said main plate includes counter-bores arranged to prevent a collision with said motor module during the winding thereof.

11. The assembly according to claim 9, wherein said gear train module and said time-setting module are arranged on a first side of said main plate, and wherein said barrel arbor includes a shouldered head in the manner of a nail mounted on a second side of said main plate opposite said first side, in a bore comprised in said main plate.

12. The assembly according to claim 9, the assembly further comprising a third mechanical timepiece sub-assembly, wherein the third mechanical timepiece sub-assembly includes, irremovably secured to said second mechanical sub-assembly, a frame-mounted self-winding device module, which is irreversibly adjusted by the irremovable securing of adjustment and/or assembly components, and which includes a barrel drive wheel guided in a guide member of said first mechanical sub-assembly in proximity to said drum, and in a jewel comprised in a flange centred on two studs comprised in said frame-mounted self-winding device module.

13. The assembly according to claim 12, wherein said time-setting module carries a support pillar for a bridge, which includes bores cooperating with the ends of shouldered studs driven into said main plate, and also includes a bore to guide said barrel arbor, and a jewel provided to guide the arbor of a small seconds wheel.

14. The assembly according to claim 13, wherein said bridge is directly welded to said main plate sandwiching the components that are already mounted, or is welded on the ends of said studs.

15. The assembly according to claim 12, wherein the third mechanical timepiece sub-assembly includes a retaining mechanism or a clip to retain said frame-mounted self-winding device module in the event of a shock and to hold said barrel drive wheel.

16. The assembly according to claim 12, wherein the third mechanical timepiece sub-assembly includes at least one sliding gear return spring mounted bearing on bosses comprised in a bridge, said spring holds a sliding gear guided in an oblong hole arranged in said bridge and on the other hand, in an oblong hole in said flange.

17. The assembly according to claim 12, wherein the said main plate includes, in proximity to a bore arranged to receive an arbor of a small seconds wheel, a guide member of an intermediate barrel drive wheel also guided in a jewel of said flange.

18. The assembly according to claim 12, wherein the third mechanical timepiece sub-assembly includes at least one sliding gear return spring mounted bearing on bosses comprised in a bridge, said at least one spring holds a sliding gear guided in an oblong hole arranged in said bridge and on the other hand, in an oblong hole in said flange, and wherein the said main plate includes, in proximity to a bore arranged to receive an arbor of a small seconds wheel, a guide member of an intermediate barrel drive wheel also guided in a jewel of said flange.

19. The assembly according to claim 12, the assembly further comprising a fourth mechanical timepiece sub-assembly, wherein the fourth mechanical timepiece sub-assembly includes, irremovably fixed to said third mechanical sub-assembly, a motion work train including a centre seconds arbor, a small seconds arbor and a pinion mounted on the side of said main plate opposite to the side where said gear train module is assembled, an intermediate wheel carried by a stud driven into said main plate, a cannon-pinion, and a minute wheel carried by a stud driven into said main plate, and an hour wheel.

20. The assembly according to claim 19, the assembly further comprising a fifth mechanical timepiece sub-assembly, wherein the fifth mechanical timepiece sub-assembly includes, fixed to said fourth mechanical sub-assembly, on said motion work train side, a holding plate or a dial, and hands.

21. The assembly according to claim 20, the assembly further comprising a sixth mechanical timepiece assembly, wherein the sixth mechanical timepiece sub-assembly includes, irremovably fixed to said fifth mechanical sub-assembly, a date module including a date drive wheel, an intermediate date wheel pivoting on a stud driven into said main plate, a date corrector wheel meshing with a date control train comprised in said mechanical stem module, a date indicator bearing on a surface of said main plate, and a holding plate for the date indicator, which is centred by pins driven into said main plate.

22. The assembly according to claim 19, the assembly further comprising a sixth mechanical timepiece sub-assembly, wherein the sixth mechanical timepiece sub-assembly includes, irremovably fixed to said fourth mechanical sub-assembly, a date module including a date drive wheel, an intermediate date wheel pivoting on a stud driven into said main plate, a date corrector wheel meshing with a date control train comprised in said mechanical stem module, a date indicator bearing on a surface of said main plate, and a holding plate for the date indicator, which is centred by pins driven into said main plate.

23. The assembly according to claim 12, the assembly further comprising a seventh mechanical timepiece sub-assembly, wherein the seventh mechanical timepiece sub-assembly includes, irremovably secured to said third mechanical sub-assembly, a self-winding module including an oscillating weight whose guide member cooperates with a complementary guide member comprised in said bridge of said frame-mounted self-winding device module, and which is held in place by a fixing screw.

24. The assembly according to claim 12, the assembly further comprising an eighth mechanical timepiece sub-assembly, wherein the eighth mechanical timepiece sub-assembly forms an autonomous mechanical timepiece movement and includes, irremovably fixed to said third mechanical timepiece sub-assembly, an escapement holder regulating module, which is a functional module to perform a particular timepiece function, irreversibly adjusted by the irremovable securing of adjustment and/or assembly components comprised in said functional module after said particular timepiece function has been adjusted and function checked on the test bench, and said escapement holder regulating module includes a regulating assembly, whose input wheel set is formed by an escape wheel arranged to be moved by a small seconds wheel comprised in said gear train module, and whose output wheel set is formed by said same escape wheel, said escapement holder regulating module including a sprung balance assembly, an escapement, and a particular pallet lever.

25. The assembly according to claim 24, wherein said main plate includes a bore to receive a stud comprised in said regulating module and around which said regulating module is angularly adjusted with respect to said third mechanical sub-assembly in an angular direction.

26. A method of assembling mechanical sub-assemblies according to claim 24, wherein said first mechanical sub-assembly is assembled by irremovably securing said main plate and said irreversibly adjusted modules comprised therein, and wherein each higher order mechanical sub-assembly is assembled on a lower order mechanical sub-assembly by irremovably securing said lower order mechanical sub-assembly and said irreversibly adjusted modules comprised in said higher order mechanical sub-assembly.

27. A mechanical timepiece movement including the assembly according to claim 1, wherein each functional module, comprised in a mechanical movement to perform a particular timepiece function, is irreversibly adjusted by the irremovable securing of adjustment and/or assembly components comprised in said functional module after said particular timepiece function has been adjusted and function checked on the test bench.

28. The mechanical movement according to the claim 27, wherein at least one said irreversibly adjusted functional module comprised therein is irremovably secured, either to said main plate or to another irreversibly adjusted functional module comprised in said mechanical movement.

29. A timepiece or watch including at least one mechanical movement according to the claim 28.

* * * * *